US009282401B2

(12) United States Patent
Lee

(10) Patent No.: US 9,282,401 B2
(45) Date of Patent: Mar. 8, 2016

(54) FLOATING AND WATERPROOF SOUND BOX

(71) Applicant: ATAKE DIGITAL TECHNOLOGY (SHENZHEN) CO., LTD., Shenzhen, Guangdong (CN)

(72) Inventor: Kuo-Tsai Lee, Taipei (TW)

(73) Assignee: ATAKE DIGITAL TECHNOLOGY (SHENZHEN) CO., LTD., Shenzhen (CN)

( * ) Notice: Subject to any disclaimer, the term of this patent is extended or adjusted under 35 U.S.C. 154(b) by 146 days.

(21) Appl. No.: 14/364,304

(22) PCT Filed: Jun. 9, 2013

(86) PCT No.: PCT/CN2013/077094

§ 371 (c)(1),
(2) Date: Jun. 11, 2014

(87) PCT Pub. No.: WO2013/185598

PCT Pub. Date: Dec. 19, 2013

(65) Prior Publication Data

US 2014/0369542 A1 Dec. 18, 2014

(30) Foreign Application Priority Data

Jun. 15, 2012 (CN) ..... 2012 2 0281793
Jun. 26, 2012 (CN) ..... 2012 3 0276259

(51) Int. Cl.
*H04R 1/02* (2006.01)
*H04R 9/06* (2006.01)
*H04R 1/44* (2006.01)

(52) U.S. Cl.
CPC .. *H04R 1/44* (2013.01); *H04R 1/02* (2013.01); *H04R 1/025* (2013.01); *H04R 2201/028* (2013.01); *H04R 2420/07* (2013.01)

(58) Field of Classification Search
CPC ..... H04R 1/02; H04R 2420/07; H04R 1/025; H04R 1/44; H04R 2201/028
USPC ..... 381/334
See application file for complete search history.

(56) References Cited

FOREIGN PATENT DOCUMENTS

| | | | |
|---|---|---|---|
| JP | 11-347258 A | | 12/1999 |
| JP | 2001-218984 A | | 8/2001 |
| JP | 2006-026031 A | | 2/2006 |
| JP | 2008-160378 A | * | 7/2008 |
| JP | 2008-160378 A | | 7/2008 |

OTHER PUBLICATIONS

International Search Report of PCT Patent Application No. PCT/CN2013/077094.

* cited by examiner

*Primary Examiner* — Paul S Kim

(57) ABSTRACT

The present invention provides a floating and waterproof sound box including a bottom house, the bottom house has a two-layer structure and includes an inner rear house located in an inner layer and an outer rear house located in an outer layer, the inner rear house is entirely enclosed, the outer rear house has a two-layer structure, at least one water inlet is defined in an outer layer of the outer rear house, and a water storage space is defined between the outer layer and in an inner layer of the outer rear house. The floating and waterproof sound box of the present invention can float over flowing water without being overturned or sinking and the inner rear house is entirely enclosed so that water penetration is avoided.

18 Claims, 5 Drawing Sheets

FLOATING AND WATERPROOF SOUND BOX

FIELD OF THE INVENTION

The present invention relates to a floating and waterproof sound box.

BACKGROUND OF THE INVENTION

Nowadays, sound boxes for playing music are often placed on tables or ground, and waterproof and moistureproof measures are needed to be taken for these sound boxes in applications. At present, sound boxes applicable over water surface are uncommon in the market, thus, sound boxes applicable over water surface are required.

SUMMARY OF THE INVENTION

A main object of the present invention is to provide a floating and waterproof sound box which can be applicable over water surface to overcome the shortcoming of the sound box in the prior art.

The floating and waterproof sound box provided in the present invention includes a bottom house, the bottom house has a two-layer structure and includes an inner rear house located in an inner layer and an outer rear house located in an outer layer, the inner rear house is entirely enclosed, the outer rear house has a two-layer structure, at least one water inlet is defined in an outer layer of the outer rear house, and a water storage space is defined between the outer layer and in an inner layer of the outer rear house.

Preferably, an annular floating ring is mounted on the bottom house.

Preferably, the floating ring is made of foaming material.

Preferably, an upper house is mounted on the floating ring, and a waterproof ring and a network cover are mounted on the upper house.

Preferably, a volume adjusting button, a power switch, and a battery charging port are formed on the upper house.

Preferably, a waterproof protection film is formed between the network cover and the upper house.

Preferably, a waterproof stopper is formed in the battery charging port.

Preferably, the waterproof stopper is made of silicone.

Preferably, the volume adjusting button and the power switch are made of silicone.

Preferably, a supporter is formed on an outer surface of the outer rear house.

Preferably, the supporter is flexibly connected to the outer rear house.

Preferably, a rubber pad is formed on an outer surface of the supporter.

Preferably, a first hooker is formed on an outer surface of the outer rear house and is flexibly connected to the outer rear house.

Preferably, a detachable second hooker is formed on a bottom portion of the outer rear house.

Preferably, the upper house, the inner rear house, and the outer rear house are bonded together via waterproof glue.

Preferably, an area of a cross section of a top portion of the outer rear house is greater than that of a cross section of a bottom portion of the outer rear house.

Preferably, a speaker sound producing cavity, a waterproof speaker, a wireless module, a sound effect integrate circuit, and a battery are provided in the inner rear house, and a weighting iron block is formed on a bottom portion of the inner rear house.

Both the bottom house and the outer rear house of the floating and waterproof sound box have two-layer structures, thus, according to the draft principle of a boat, the sound box can float over the water surface without being overturned or sinking; in further combined with the annular floating ring, the sound box can float over flowing water without being overturned or sinking and the inner rear house is entirely enclosed for preventing water penetration.

Technical means taken for achieving the intended purposes of the present invention, and functional features and advantages of the present invention are further described below with reference to the accompanying drawings.

DETAILED DESCRIPTION OF THE INVENTION

In order to further illustrate technical means taken for achieving the intended purpose of the present invention and advantages thereof, embodiments, methods, steps, and advantages of a method and a system for automatic adaptation of hardware encoding and decoding and a video communication encoding and decoding method are described in more detail below with reference to the accompanying drawings and the preferred embodiments.

Figure 1:
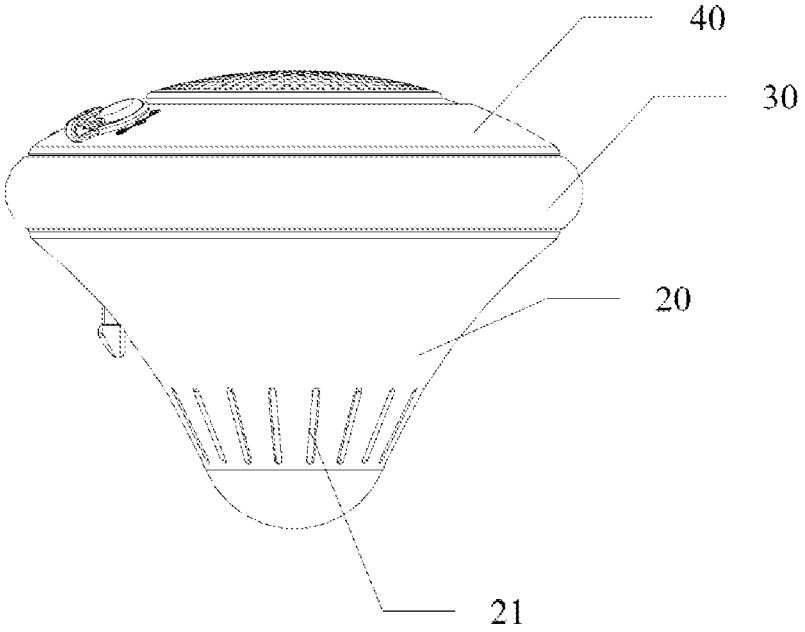
FIG. 1 is a front view of a floating and waterproof sound box in accordance with an embodiment of the present invention.
Figure 2:
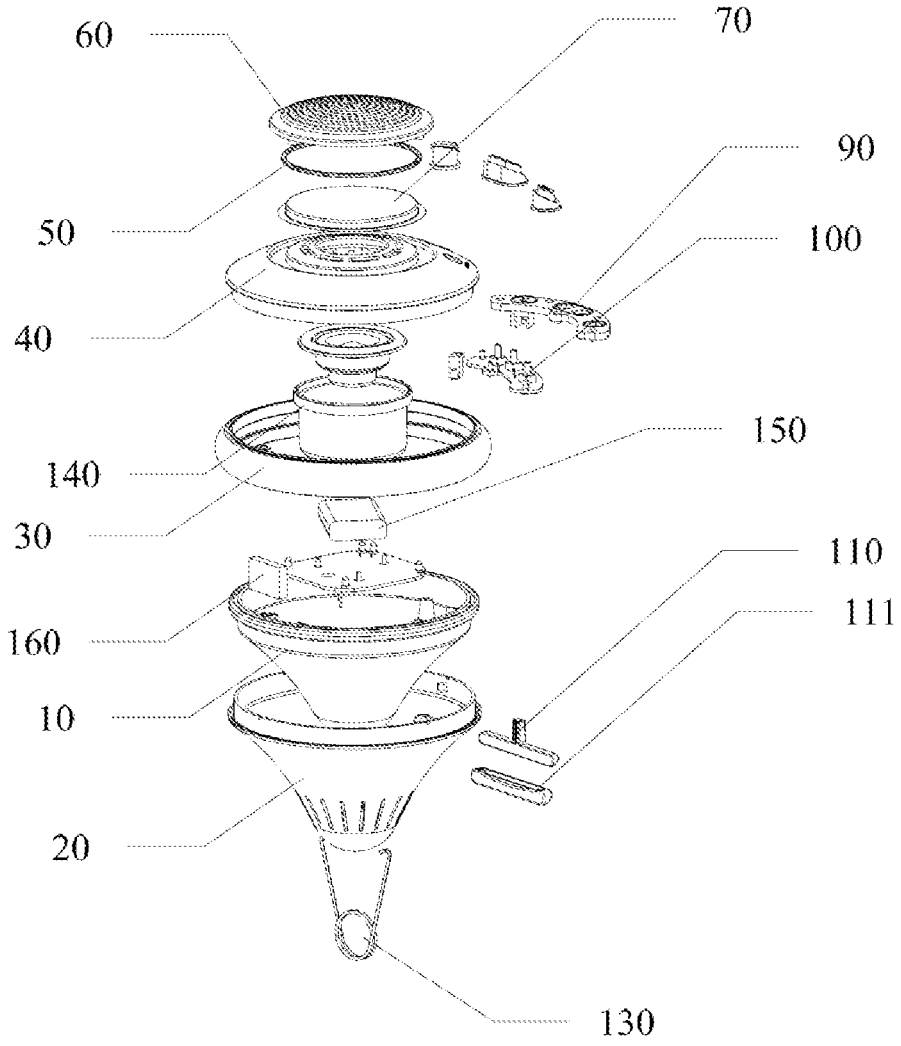
FIG. 2 is an exploded view of the floating and waterproof sound box.
Figure 3:
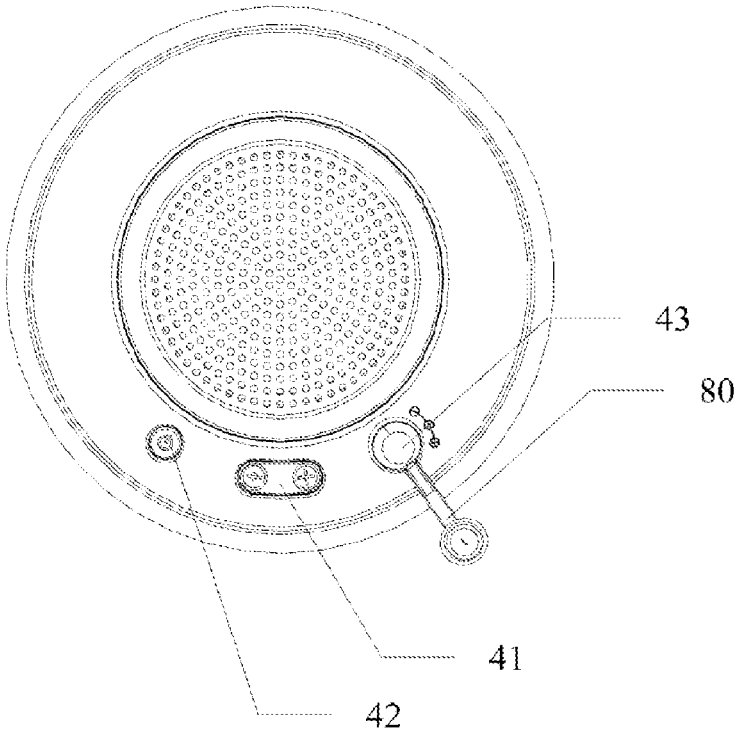
FIG. 3 is a schematic view of an upper house of the floating and waterproof sound box.
Figure 4:
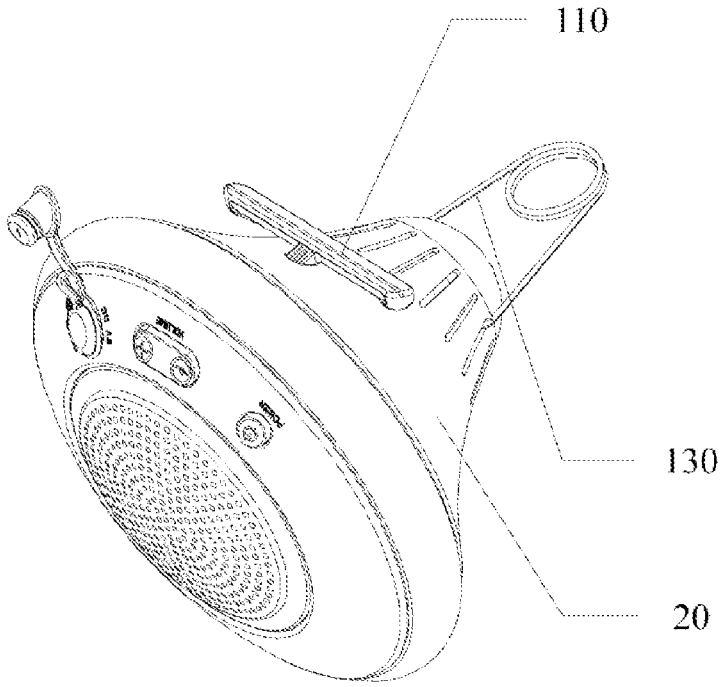
FIG. 4 is a perspective view of a floating and waterproof sound box with a supporter in accordance with a first embodiment of the present invention.
Figure 5:
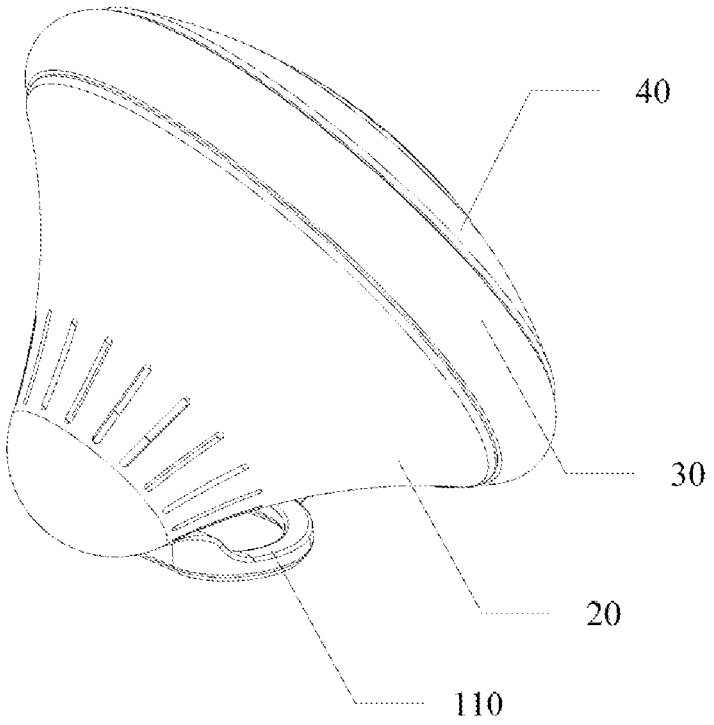
FIG. 5 is a perspective view of a floating and waterproof sound box with a supporter in accordance with a second embodiment of the present invention.
Figure 6:
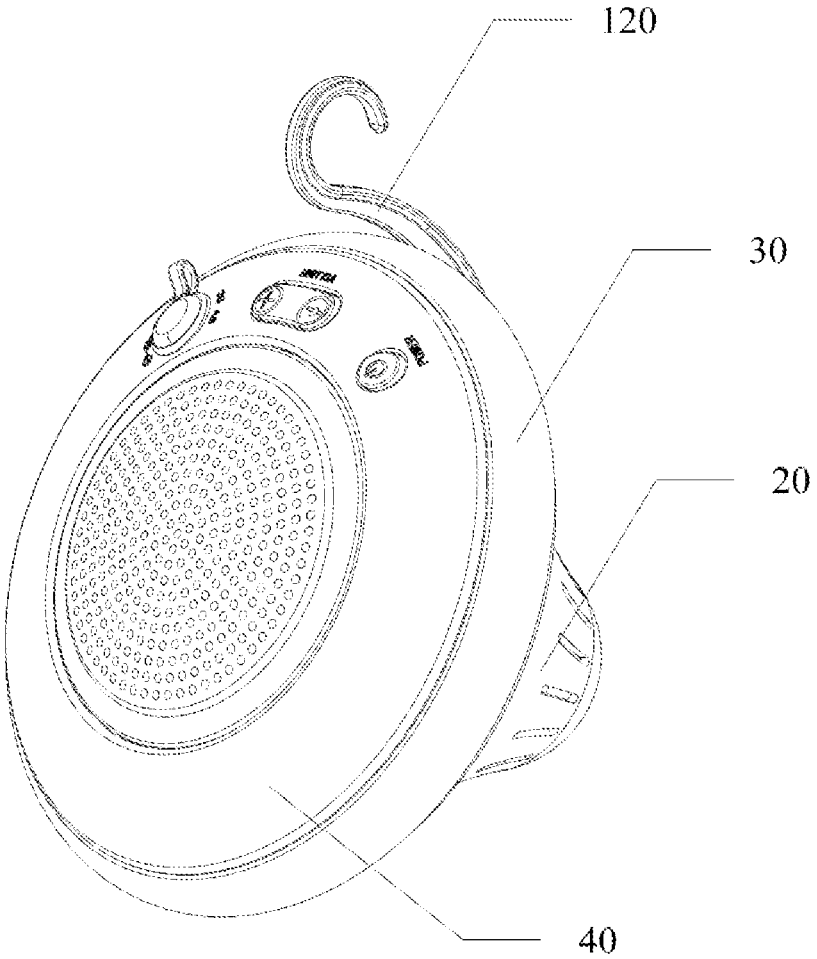
FIG. 6 is a perspective view of a floating and waterproof sound box with a first hooker in accordance with an embodiment of the present invention.

FIG. 1 is a front view of a floating and waterproof sound box in accordance with an embodiment of the present invention; FIG. 2 is an exploded view of the floating and waterproof sound box; FIG. 3 is a schematic view of an upper house of the floating and waterproof sound box; FIG. 4 is a perspective view of a floating and waterproof sound box with a supporter in accordance with a first embodiment of the present invention; FIG. 5 is a perspective view of a floating and waterproof sound box with a supporter in accordance with a second embodiment of the present invention; and FIG. 6 is a perspective view of a floating and waterproof sound box with a first hooker in accordance with an embodiment of the present invention.

The present invention provides a floating and waterproof sound box having a bottom house. The bottom house has a two-layer structure and includes an inner rear house 10 located in an inner layer and an outer rear house 20 located in an outer layer. The inner rear house 10 is entirely enclosed. The outer rear house 20 also has a two-layer structure with a water storage space being defined between an outer layer and an inner layer thereof. A plurality of water inlets are defined in the outer layer of the outer rear house 20. An annular floating ring 30 made of foaming material is mounted on the bottom house. An upper house 40 is mounted on the floating ring 30, and a waterproof ring 50 and a network cover 60 are mounted on the upper house 40. A volume adjusting button 41, a power switch 42, and a battery charging port 43 are formed on the upper house 40.

Furthermore, a waterproof protection film 70 is formed between the network cover 60 and the upper house 40. When the sound box falls into water or falls down due to fluctuation, the waterproof protection film 70 can prevent water from entering the sound box through the network cover 60. In an embodiment, the waterproof protection film 70 is made of thermoplastic polyurethane flexible material.

Furthermore, a waterproof stopper 80 is formed in the battery charging port 43 for preventing water from entering the sound box through the battery charging port 43. In an embodiment, the waterproof stopper 80 is made of silicone.

Furthermore, the volume adjusting button 41 and the power switch 42 are made of silicone. Since silicone has a good plasticity, the silicone buttons can tightly contact the upper house 40, thereby preventing water from entering the sound box through gaps between the buttons and the upper house 40. The volume adjusting button 41, the power switch 42, and the waterproof stopper 80 are inserted into through holes defined in the upper house 40 to be mounted on a fixing panel 90. A vice PCB 100 is mounted on the fixing panel 90. The vice PCB 100 includes a plurality of fixing shafts respectively engageable with the volume adjusting button 41, the power switch 42, and the waterproof stopper 80. The volume adjusting button 41, the power switch 42, and the waterproof stopper 80 are hollow, and the fixing shafts are inserted into the volume adjusting button 41, the power switch 42, and the waterproof stopper 80 for fixing the volume adjusting button 41, the power switch 42, and the waterproof stopper 80 to the vice PCB 100. The fixing panel 90 and the vice PCB 100 then are screwed together. In this way, the vice PCB 100, the fixing panel 90, the volume adjusting button 41, the power switch 42, and the waterproof stopper 80 are fixed on the upper house 40.

Furthermore, a supporter 110 is formed on an outer surface of the outer rear house 20. When the floating and waterproof sound box is placed on a table rather than in water, the supporter 110 can support the sound box such that the sound box is stabilized. In an embodiment, the supporter 110 is flexibly connected to the outer rear house 20 and a rubber pad 111 is formed on an outer surface of the supporter 110.

Furthermore, a first hooker 120 is formed on the outer surface of the outer rear house 20 and is detachably connected to the outer rear house 20, allowing the sound box to be hung up. Since the supporter 110 and the first hooker 120 are both flexibly connected to the outer rear house 20, a user may choose to place the sound box on ground via the supporter 110 or hang up the sound box via the first hooker 120. The supporter may be T-shaped as shown in FIG. 5 or circular-shaped as shown in FIG. 6.

Furthermore, a second hooker 130 is formed on a bottom portion of the outer rear house 20, allowing the sound box to be hung on the wall or other objects for saving space.

Furthermore, the upper house 40, the inner rear house 10, and the outer rear house 20 are bonded together via waterproof glue.

An area of a cross section of a top portion of the outer rear house 20 is greater than that of a cross section of a bottom portion of the outer rear house 20. A speaker sound producing cavity, a waterproof speaker, a wireless module, a sound effect integrate circuit, and a battery 150 are formed in the inner rear house 10. A weighting iron block 160 is formed on a bottom portion of the inner rear house 10 such that the floating and waterproof sound box can be balanced and a gravity center thereof can face down.

Both the bottom house and the outer rear house 20 of the floating and waterproof sound box have two-layer structures, thus, according to the draft principle of a boat, the sound box can float over the water surface without being overturned or sinking; in further combined with the annular floating ring 30, the floating and waterproof sound box can float over flowing water without being overturned or sinking and the inner rear house 10 is entirely enclosed for preventing water penetration.

After the floating and waterproof sound box is placed over the water surface and draws water, the sound box is half in the water with the part thereof above the annular floating ring 30 exposed above the water surface. The sound box floats on the water and produces sound, thus, the floating and waterproof sound box can operate and produce sound in regardless of the water fluctuation, which allows the sound box to be applicable in any outdoor water-related environment such as a swimming pool, a lake pool, a stream or a river, and a seaside and also to be applicable in any indoor water-related environment such as an indoor swimming pool, a bathhouse, a hot spring, and even a home bathtub, in regardless of the weather.

The foregoing descriptions are only preferred embodiments of the present invention and are not intended to limit the present invention. Any modification, equivalent replacement and improvement made under the spirit and principle of the present invention should be included in the protection scope thereof.

What is claimed is:

1. A floating and waterproof sound box comprising a bottom house, wherein the bottom house has a two-layer structure and comprises an inner rear house located in an inner layer and an outer rear house located in an outer layer, the inner rear house is entirely enclosed, the outer rear house has a two-layer structure, at least one water inlet is defined in an outer layer of the outer rear house, and a water storage space is defined between the outer layer and in an inner layer of the outer rear house.

2. The floating and waterproof sound box as claimed in claim 1, wherein an annular floating ring is mounted on the bottom house.

3. The sound box as claimed in claim 2, wherein the floating ring is made of foaming material.

4. The sound box as claimed in claim 2, wherein an upper house is mounted on the floating ring, and a waterproof ring and a network cover are mounted on the upper house.

5. The sound box as claimed in claim 4, wherein a volume adjusting button, a power switch, and a battery charging port are formed on the upper house.

6. The sound box as claimed in claim 5, wherein a waterproof protection film is formed between the network cover and the upper house.

7. The sound box as claimed in claim 6, wherein a waterproof stopper is formed in the battery charging port.

8. The sound box as claimed in claim 7, wherein the waterproof stopper is made of silicone.

9. The sound box as claimed in claim 6, wherein the volume adjusting button and the power switch are made of silicone.

10. The sound box as claimed in claim 9, wherein a supporter is formed on an outer surface of the outer rear house.

11. The sound box as claimed in claim 10, wherein the supporter is flexibly connected to the outer rear house.

12. The sound box as claimed in claim 11, wherein a rubber pad is formed on an outer surface of the supporter.

13. The sound box as claimed in claim 9, wherein a first hooker is formed on an outer surface of the outer rear house and is flexibly connected to the outer rear house.

14. The sound box as claimed in claim 12, wherein a detachable second hooker is formed on a bottom portion of the outer rear house.

15. The sound box as claimed in claim 14, wherein the upper house, the inner rear house, and the outer rear house are bonded together via waterproof glue.

16. The sound box as claimed in claim 1, wherein an area of a cross section of a top portion of the outer rear house is greater than that of a cross section of a bottom portion of the outer rear house.

17. The sound box as claimed in claim 1, wherein a speaker sound producing cavity, a waterproof speaker, a wireless module, a sound effect integrate circuit, and a battery are provided in the inner rear house, and a weighting iron block is formed on a bottom portion of the inner rear house.

18. The sound box as claimed in claim 13, wherein a detachable second hooker is formed on a bottom portion of the outer rear house.

* * * * *